US006918522B2

(12) United States Patent
Song

(10) Patent No.: US 6,918,522 B2
(45) Date of Patent: Jul. 19, 2005

(54) NAILING MACHINE

(76) Inventor: Suk Ju Song, 28-13, Bokdae-Dong, Heungdeok-Gu, Cheongju-City, Chungcheongbuk-Do 361-270 (KR)

( * ) Notice: Subject to any disclaimer, the term of this patent is extended or adjusted under 35 U.S.C. 154(b) by 0 days.

(21) Appl. No.: 10/477,213

(22) PCT Filed: May 10, 2002

(86) PCT No.: PCT/KR02/00874

§ 371 (c)(1),
(2), (4) Date: Jun. 24, 2004

(87) PCT Pub. No.: WO02/094510

PCT Pub. Date: Nov. 28, 2002

(65) Prior Publication Data

US 2004/0222265 A1 Nov. 11, 2004

(30) Foreign Application Priority Data

May 11, 2001 (KR) ..... 2001-13863 U

(51) Int. Cl.[7] ..... B27F 7/17

(52) U.S. Cl. ..... 227/8; 227/2; 227/120; 227/156; 173/20

(58) Field of Search ..... 227/2, 8, 120, 227/156; 206/459.1; 173/20; 81/57.23

(56) References Cited

U.S. PATENT DOCUMENTS 4,197,974 A 4/1980 Morton et al.
4,386,725 A * 6/1983 Chambers ..... 227/2
4,506,819 A * 3/1985 Rand ..... 227/120
4,679,719 A * 7/1987 Kramer ..... 227/5
4,715,522 A 12/1987 Jordan
5,125,151 A * 6/1992 Smart ..... 29/706
5,180,091 A 1/1993 Ota
5,667,127 A 9/1997 Ichikawa
6,036,072 A * 3/2000 Lee ..... 227/120
6,267,284 B1 * 7/2001 Clark ..... 227/8
6,651,862 B2 * 11/2003 Driscoll et al. ..... 227/123
6,796,476 B2 * 9/2004 Birk et al. ..... 227/2

* cited by examiner

*Primary Examiner*—Rinaldi I. Rada
*Assistant Examiner*—Thanh Truong
(74) *Attorney, Agent, or Firm*—Birch, Stewart, Kolasch & Birch, LLP

(57) ABSTRACT

Disclosed is a nailing machine capable of indicating an existence or non-existence and the residual quantity of a nail in a cartridge. The nailing machine includes a main body, a nose portion and a cartridge. The main body includes a trigger lever mounted to a lower portion of a grip portion. The cartridge has a pressing plate and a pressing spring. The nailing machine further comprises a displaying unit having a display plate, a connecting plate and a trigger lever stopper. An alarming unit includes a first and a second ground plates, a battery and a recognition part. The conductive plate selectively contacts with the first ground plate and the second ground plate. The trigger lever may be stopped in accordance with the detection result after notifying a worker that the nail is exhausted with generating an audible alarm sound and a visual alarm light.

11 Claims, 6 Drawing Sheets

NAILING MACHINE

This application is the national phase under 35 U.S.C. § 371 of PCT International Application No. PCT/KR02/00874 which has an International filing date of May 10, 2002, which designated the United States of America.

TECHNICAL FIELD

The present invention relates to a nailing machine for use with an air pressure, and more particularly to a nailing machine capable of indicating an existence or non-existence of a nail in a cartridge and the residual quantity of the nail in the cartridge, of which a trigger lever may be stopped in accordance with the detection result after notifying a worker that the nail is exhausted by generating an audible alarm sound and a visual alarm light, which is capable of improving the working efficiency and thereby preventing unreliable construction work from being performed.

BACKGROUND ART

Generally, a nailing machine has been widely used for manufacturing furniture and for performing an interior finish work. This nailing machine operates by the aid of a hydraulic air supplied from an outer air source. Conventionally, the nailing machine includes a driving cylinder, a main body for containing the driving cylinder and a driving piston moving upwards and downwards within the driving cylinder. The nailing machine further includes a nose portion for guiding a plurality of nails disposed at a lower portion of the main body and a cartridge for guiding the nails toward the nose portion. The main body is provided with a grip portion for guiding a compressed air toward the driving cylinder.

A cover is attached to one side surface or a lower surface of the cartridge in order to secure the nails in the cartridge. A pressing plate and a pressing spring for pushing the nails toward the nose portion are disposed in the cover.

However, in the nailing machine according to the prior art, it is impossible to indicate an existence or non-existence of a nail in a cartridge and to indicate the residual quantity of nail in the cartridge. If the nail is exhausted, a worker cannot perceive this fact and thereby constructions work being performed by using the conventional nailing machine lacks of accuracy. Consequently, it is actually impossible to perform a reliable construction work at the conventional nailing machine. In order to certify existence or non-existence and the residual quantity of nail in the cartridge during performance of the nailing work at the conventional nailing machine, it is required to frequently stop the nailing machine. Therefore, there is a problem that the work efficiency is low and the reliability is low at the conventional nailing machine.

DISCLOSURE OF INVENTION

The present invention is contrived to solve the foregoing problems. An object of the present invention is to provide a nailing machine in which the existence and the remaining quantity of nail in a cartridge are automatically displayed, the trigger operation of a trigger lever may be stopped after confirming the fact that the nail in the cartridge is exhausted on the basis of a sound and an alarming light, the working efficiency is highly increased and the fraudulent work is prevented.

In order to achieve the above first object, the present invention provides a nailing machine having a main body for containing a driving cylinder and a driving piston, a nose portion for guiding nails being installed at a lower portion of the main body, and a cartridge, the main body including a grip portion for guiding a compressed air toward the driving cylinder and a trigger lever mounted to a lower portion of the grip portion, the cartridge having a pressing plate and a pressing spring, one side surface of the pressing plate being covered by a cover, the pressing plate having function to push the nails toward the nose portion, characterized by comprising:

a displaying unit having a display plate, a connecting plate and a trigger lever stopper, in which the display plate is formed in one body with the pressing plate and is perpendicular to the one side surface of the pressing plate, the displaying plate is projected toward the outside through a guiding hole formed through the cover in the longitudinal direction when the one side surface of the pressing plate being covered by the cover, the connecting plate is formed in one body with the display plate and extends toward the nose portion at a predetermined length along the one side surface of the pressing plate, the trigger lever stopper being mounted to an upper surface of the display plate, in which an insulating plate is attached to a distal end of the connecting plate, a conductive plate is attached to a part of an upper surface of the insulating plate; and an alarming unit including a first and a second ground plates formed at one side surface of the nose portion, a battery for supplying the first ground plate and the second ground plate with an electric source, and a recognition part, in which the first ground plate and the second ground pate are spaced apart from each other at a predetermined gap and they extend toward the connecting plate, a first ground protrusion and a second ground protrusion are respectively formed at the center portions of the first ground plate and the second ground plate, the conductive plate selectively contacting with the first ground plate and the second ground plate, the battery is disposed at the one side surface of the main body, the recognition part is disposed at a position adjacent to the battery and is electrically connected with the battery.

Preferably, the recognition part comprises a small electrical bulb for emitting a light or an alarm device for generating a sound.

As described above, the apparatus according to the present invention is able to indicate the existence and the residual quantity of the nail contained in the cartridge. Furthermore, the apparatus is able to provide a worker with the fact that the nail is exhausted in the cartridge, as a sound and a light. As a result, the work efficiency may be enhanced through reduction in the number of processes. Consequently, the apparatus increases work efficiency and this make it possible to prevent unreliable execution of nailing works.

BRIEF DESCRIPTION OF DRAWINGS

The above object and other characteristics and advantages of the present invention will become more apparent by describing in detail preferred embodiments thereof with reference to the attached drawings, in which.

BEST MODE FOR CARRYING OUT THE INVENTION

Hereinafter, preferred embodiments of the present invention will be explained in more detail with reference to the accompanying drawings.

Figure 1:
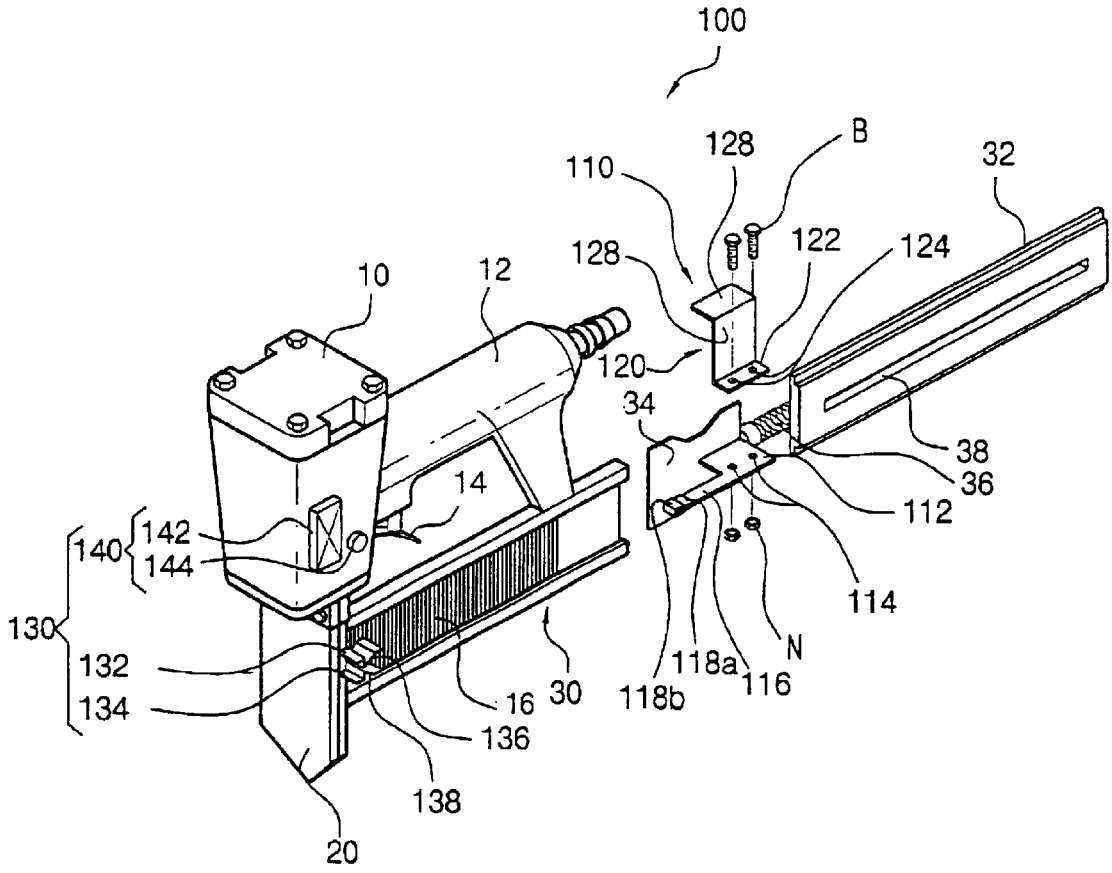
FIG. 1 is a partially exploded view in perspective of a nailing machine according to a preferred first embodiment of the present invention.
Figure 2:
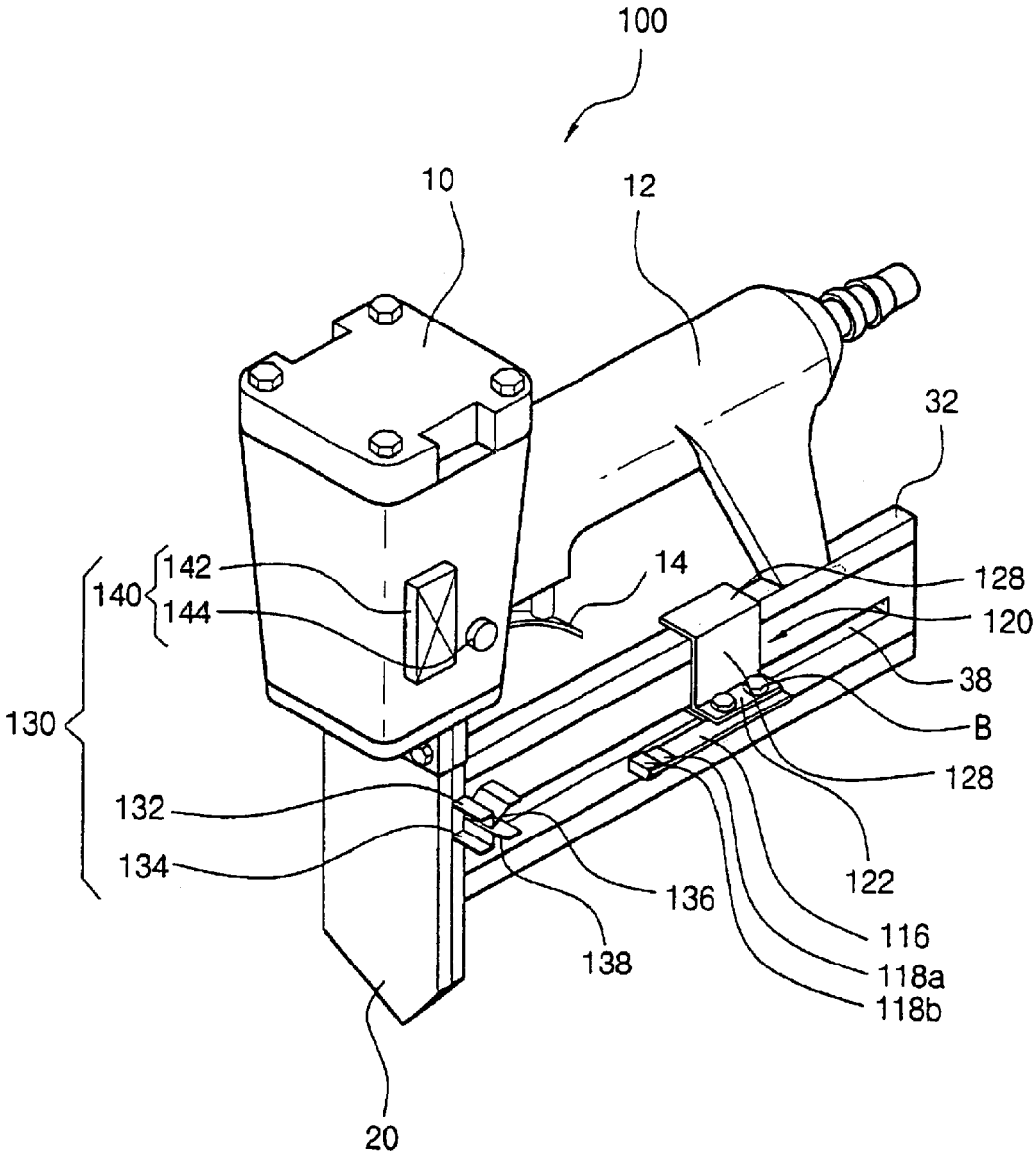
FIG. 2 is a perspective view for showing a combining state of the nailing machine of FIG. 1.

Referring to FIGS. 1 and 2, a nailing machine 100 according to the first preferred embodiment of the present invention includes a main body 10 for containing a driving cylinder (not shown) and a driving piston (not shown) moving upwards and downwards within the driving cylinder. The main body 10 is provided with a grip portion 12 for guiding a compressed air toward the driving cylinder, and a trigger lever 14 mounted to a lower portion of the grip portion 12. The nailing machine 100 further includes a nose portion 20 for guiding a plurality of nails 16 disposed at a lower portion of the main body 10. Furthermore, the nailing machine 100 includes a cartridge 30 having a pressing plate 34 and a pressing spring 36 for pushing the nails 16 toward the nose portion 20 therein. In order to secure the nails 16 in the cartridge 30, one side surface of the cartridge 30 is covered by a cover 32. A guide hole 38 is formed at the cover 32 in the longitudinal direction. A display unit 110 and an alarming unit 130 are mounted to the main body 10 and the cartridge 30.

The display unit 110 is provided with a display plate 112, a connecting plate 116 and a trigger lever stopper 120. Firstly, the displaying plate 112 is formed in one body with the pressing plate 34 and is perpendicular to one side surface of the pressing plate 34. The displaying plate 112 is projected toward the outside through the guiding hole 38 formed through the cover 32. First through holes 114 are formed through a middle portion of the displaying plate 112. The connecting plate 116 is formed in one body with the displaying plate 112 and extends toward the nose portion 20 at a predetermined length along the one side surface of the pressing plate 34. At this time, an insulating plate 118*a* made of an insulator is attached to a distal end of the connecting plate 116. A conductive plate 118*b* made of an electric conductor is attached to a part of an upper surface of the insulating plate 118*a*. At this time, a part of the insulating plate 118*a* is exposed to the outside at the distal end of the conductive plate 118*b*.

The trigger lever stopper 120 comprises a first stopping plate 122, a second stopping plate 126 and a third stopping plate 128. Second through holes 122 corresponding to the first through holes 114 are formed through a middle portion of the first stopping plate 122. The first stopping plate 122 is engaged with the display plate 112 by inserting bolts(B) into the second through holes 124 and the first through holes 114 which are aligned with each other in the vertical direction. After inserting the belts(B), nuts(N) are fitted onto distal ends of the bolts(B). The second stopping plate 126 vertically extends between the first stopping plate 122 and the third stopping plate 128. The first stopping plate 122 horizontally extends from a lower end of the second stopping plate 126. The third stopping plate 128 horizontally extends from an upper end of the second stopping plate 126 in an opposite direction about the first stopping plate 122. The alarming unit 130 is disposed at a one side of the display unit 110.

The alarming unit 130 is provided with a first ground plate 132, a second ground plate 134 and an alarming device 140. Firstly, the first ground plate 132 is spaced apart from the second ground plate 134 at a predetermined gap and they extend toward the connecting plate 116 at a one side surface of the nose portion 20. At this time, a first ground protrusion 136 and a second ground protrusion 138 are formed at the center portions of the first ground plate 132 and the second ground plate 134, respectively. At this time, the distance between the first ground protrusion 136 and the second ground protrusion 138 is the same as the thickness of the conductive plate 118*b*. Meanwhile, the alarming device 140 includes a battery 142 and a recognition part 144, which are disposed at the one side surface of the main body 10. The battery 142 provides the first ground plate 132 and the second ground plate 134 with an electric source. The recognition part 144 comprises a small electrical bulb for emitting a light or an alarming device for generating a sound.

Meanwhile, a stopping bar 150 is mounted to a one side of the trigger lever 14 mounted to the lower portion of the grip portion 12. The stopper bar 150 extends from the one side of the trigger lever 14 to a position adjacent to an upper portion of the cartridge 30. The operation of the trigger lever 14 is controlled by selective contact between a distal end of the stopping bar 150 and the upper surface of the third stopping plate 128 of the trigger lever stopper 120. A position holding band 18 is mounted to the lower portion of the main body 10 at a position adjacent to the trigger lever 14. The position holding band 18 has function to smoothly guide the trigger lever 14 downwards with enclosing the lower portion of the stopping bar 150.

Herein below, an operating mode of the nailing machine 100 according to the first preferred embodiment of the present invention as described above will be explained with reference to FIGS. 3A and 3B.

First, the cover 32 of the cartridge 30 is opened by pulling the pressing plate 34 disposed in the cartridge 30 in one direction, and thereby the nails 16 are mounted in the cartridge 30. After mounting the nails 16, the cartridge 30 is closed by the cover 32. Under this state, a worker may perform a desired work after connecting the grip portion 12 with a compressor (not shown).

Figure 3A:
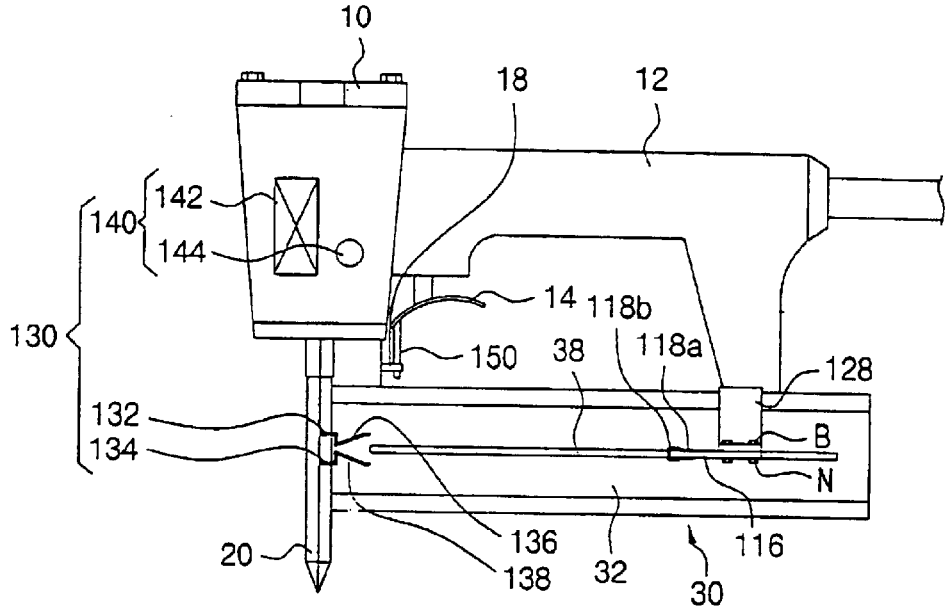
FIGS. 3A and 3B show operational states of the nailing machine according to the preferred first embodiment of the present invention.
Figure 3B:
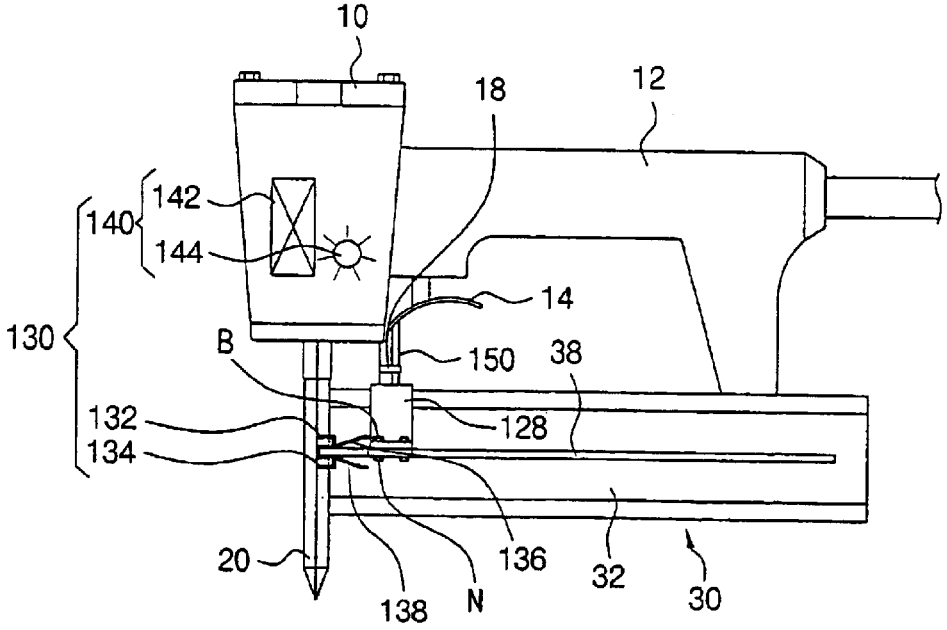

When the worker finishes the desired work, the pressing plate 34 pushes the nails 16 toward the nose portion 20 with the aid of the elastic force of the pressing spring 36 (referred to FIG. 3A). At this time, the worker can certify the remaining quantity of nails 16 in the cartridge 30 by seeing the display plate 112 which is exposed to the outside through the guide hole 38.

Meanwhile, if the nails 16 is exhausted during performing a work without certifying the remaining quantity of nails 16 in the cartridge 30, the connecting plate 116 is guided between the first ground plate 132 and the second ground plate 134. Continuously, the conductive plate 118*b* of the connecting plate 116 makes the recognition part 144 operate by contacting with the first ground protrusion 136 and the second ground protrusion 138(referred to FIG. 3B). When the conductive plate 118*b* passes by the first ground protrusion 136 and the second ground protrusion 138, the first ground protrusion 136 and the second ground protrusion 138 are closely contacted with the insulating plate 118*a*. Consequently, the recognition part 144 stops operating.

In the meantime, the third stopping plate 128 transferred toward the nose portion 20 along the display plate 112 is positioned below the stopping bar 150. Consequently, the operation of the trigger lever 14 is controlled by selectively contacting between the distal end of the stopper bar 150 and the upper surface of the fourth stopping unit 228.

Figure 4:
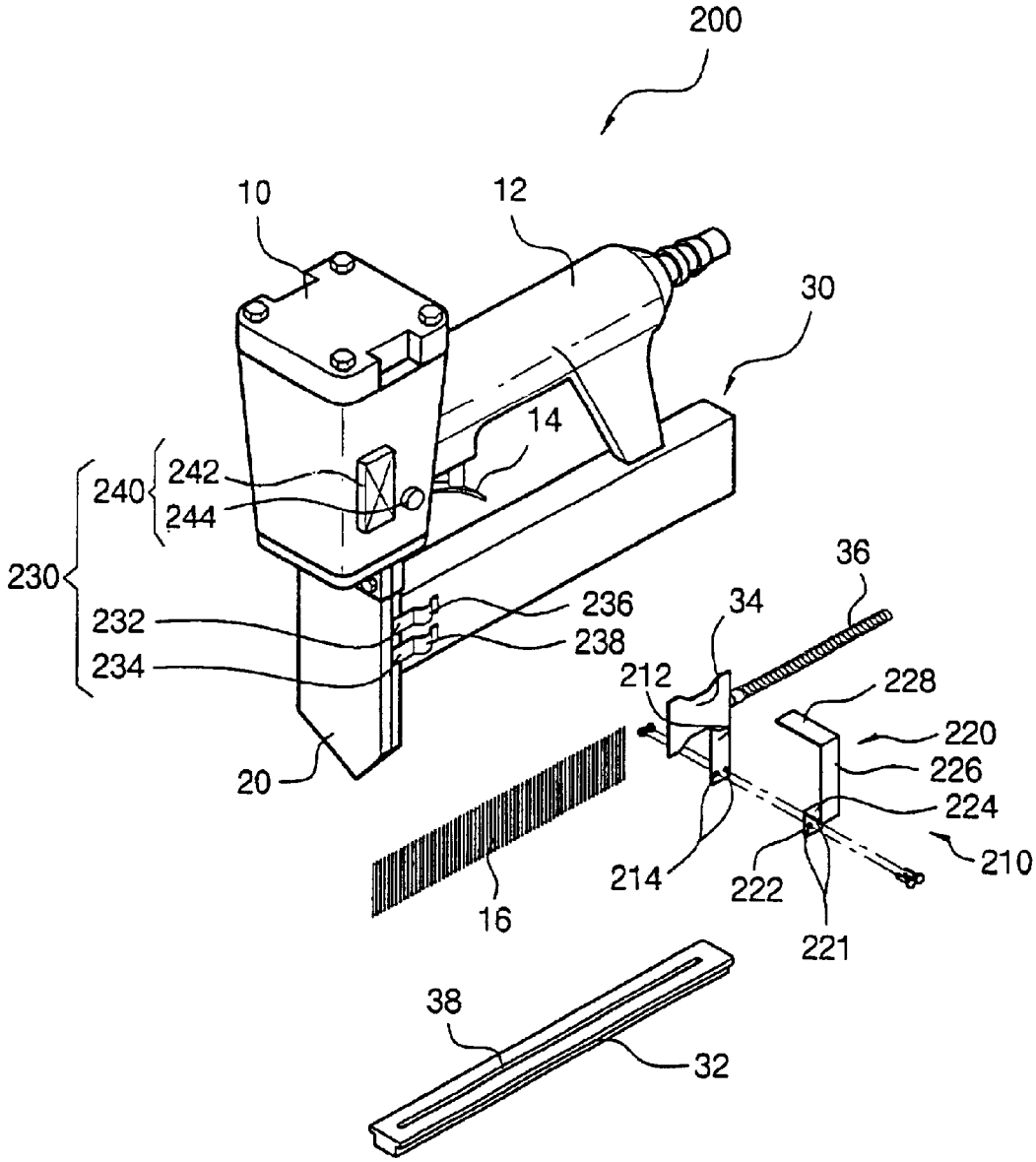
FIG. 4 is a partially exploded view in perspective of a nailing machine according to a preferred second embodiment of the present invention.
Figure 5:
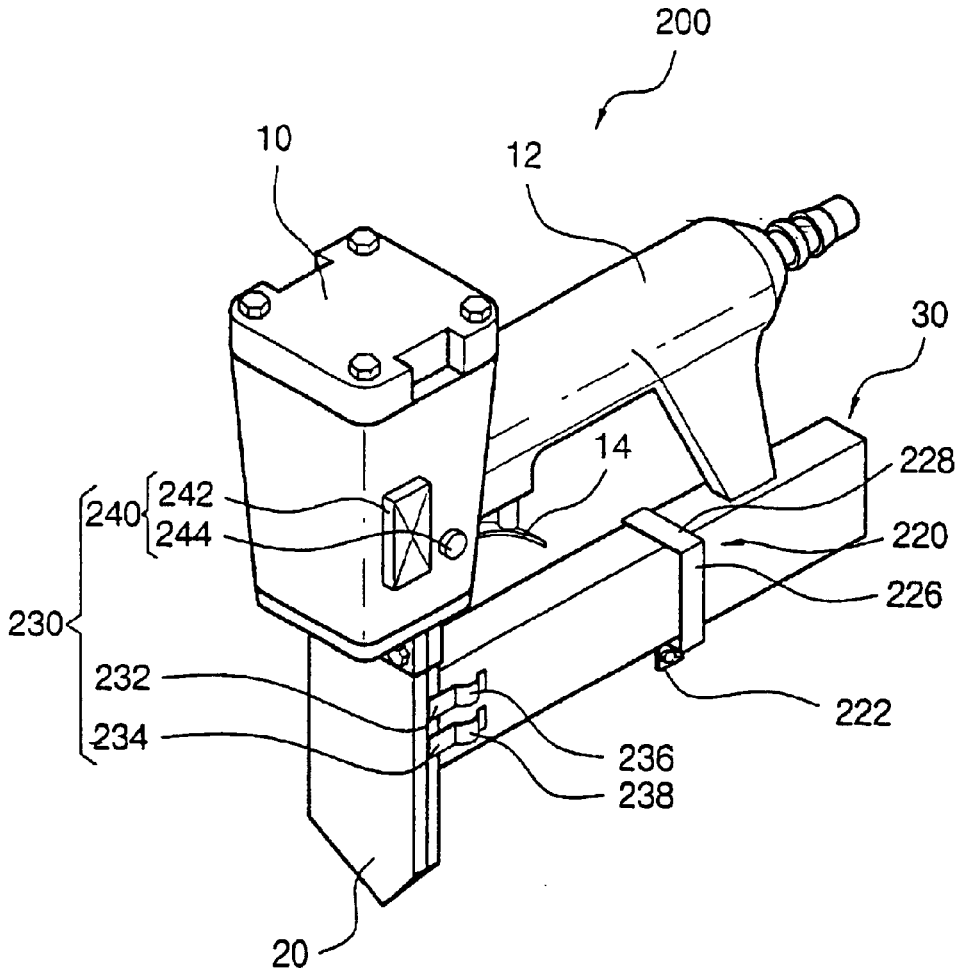
FIG. 5 is a perspective view for showing a combining state of the nailing machine of FIG. 4.

FIGS. 4 and 5 show a nailing machine according to a preferred second embodiment of the present invention.

Referring to FIGS. 4 and 5, a nailing machine 200 according to the second preferred embodiment of the present invention includes a main body 10 for containing a driving cylinder (not shown) and a driving piston (not shown) moving upwards and downwards within the driving cylinder. The main body 10 is provided with a grip portion 12 for guiding a compressed air toward the driving cylinder, and a trigger lever 14 mounted to a lower portion of the grip portion 12. The nailing machine 100 further includes a nose portion 20 for guiding a plurality of nails 16 disposed at a lower portion of the main body 10. Furthermore, the nailing machine 100 includes a cartridge 30 having a pressing plate 34 and a pressing spring 36 for pushing the nails 16 toward the nose portion 20 therein. In order to secure the nails 16 in the cartridge 30, one side surface of the cartridge 30 is closed by a cover 32. A guide hole 38 is formed at the cover 32 in the longitudinal direction. A display unit 210 and an alarming unit 230 are mounted to the main body 10 and the cartridge 30.

The display unit 210 is provided with a display plate 212 and a trigger lever stopper 220. Firstly, the display plate 212 is formed in one body with the pressing plate 34. The displaying plate 212 is projected toward the outside through the guiding hole 38 formed through the cover 32. First through holes 214 are formed through a low portion of the displaying plate 212.

The trigger lever stopper 220 comprises a first stopping plate 222, a second stopping plate 224, a third stopping plate 226 and a fourth stopping plate 228. Second through holes 221 corresponding to the first through holes 214 are formed through a low portion of the first stopping plate 222. The first stopping plate 222 is engaged with the display plate 212 by inserting bolts(B) into the second through holes 221 and the first through holes 214 which are aligned with each other in the horizontal direction. After inserting the bolts(B), nuts(N) are fitted onto distal ends of the bolts(B). The second stopping plate 224 horizontally extends between an upper end of the first stopping plate 222 and a lower end of the third stopping plate 226. In other words, the first stopping plate 222 vertically downwardly extends from one side end of the second stopping plate 224 and the third stopping plate 226 vertically upwardly extends from the other side end of the second stopping plate 224. Accordingly, the second stopping plate 224 is perpendicular to the first stopping plate 222 and the third stopping plate 226. The fourth stopping plate 228 horizontally extends from a distal end of the third stopping plate 226 in a same direction about the second stopping plate 224. The alarming unit 230 is disposed at a one side of the display unit 210.

The alarming unit 230 is provided with a first ground plate 232, a second ground plate 234 and an alarming device 240. Firstly, the first ground plate 232 is spaced apart from the second ground plate 234 at a predetermined gap and they extend toward the trigger lever stopper 220 at a one side surface of the nose portion 20. At this time, a first ground protrusion 236 and a second ground protrusion 238 are formed at the center portions of the first ground plate 232 and the second ground plate 234, respectively. The first ground protrusion 236 and the second ground protrusion 238 are closely contacted with an inner side surface of the third stopping plate 226.

Meanwhile, the alarming device 240 includes a battery 242 and a recognition part 244, which are disposed at the one side surface of the main body 10. The battery 242 provides the first ground plate 232 and the second ground plate 234 with an electric source. The recognition part 244 comprises a small electrical bulb for emitting a light or an alarming device for generating a sound.

Meanwhile, a stopping bar 150 is mounted to a one side of the trigger lever 14 mounted to the lower portion of the grip portion 12. The stopper bar 150 extends from one side of the trigger lever 14 to a position adjacent to an upper portion of the cartridge 30. The operation of the trigger lever 14 is controlled by selective contact between the distal end of the stopper bar 150 and the upper surface of the fourth stopping unit 228 of the trigger lever stopper 220. A position holding band 18 is mounted to the lower portion of the main body 10 at a position adjacent to the trigger lever 14. The position holding band 18 has function to smoothly guide the trigger lever 14 downwards with enclosing the stopping bar 150.

Herein below, an operating mode of the nailing machine 100 according to the second preferred embodiment of the present invention as described above will be explained with reference to FIGS. 6A and 6B.

Firstly, the cover 32 of the cartridge 30 is opened by pulling the pressing plate 34 disposed in the cartridge 30 in one direction, and thereby the nails 16 are mounted in the cartridge 30. After mounting the nails 16, the cartridge 30 is closed by the cover 32. Under this state, a worker may perform a desired work after connecting the grip portion 12 with a compressor (not shown).

Figure 6A:
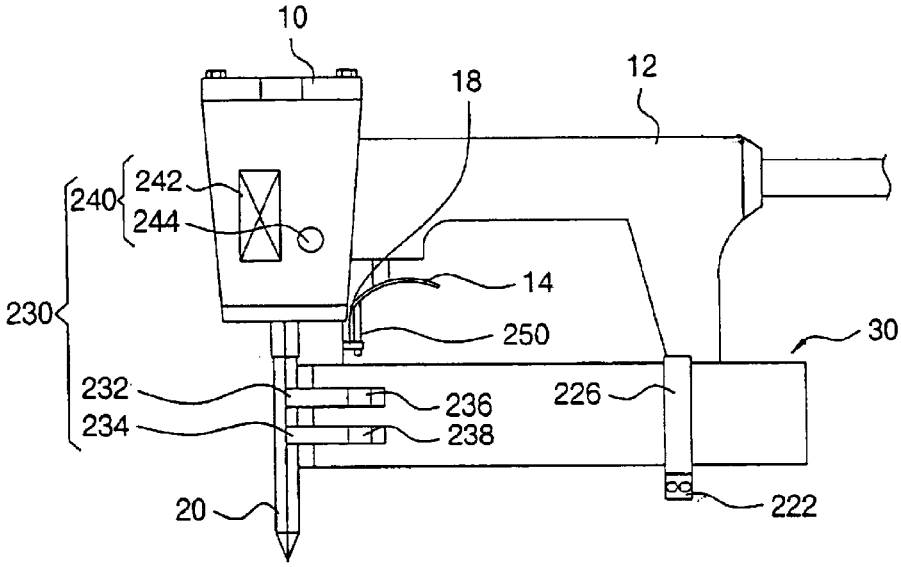
FIGS. 6A and 6B show operational states of the nailing machine according to the preferred second embodiment of the present invention.
Figure 6B:
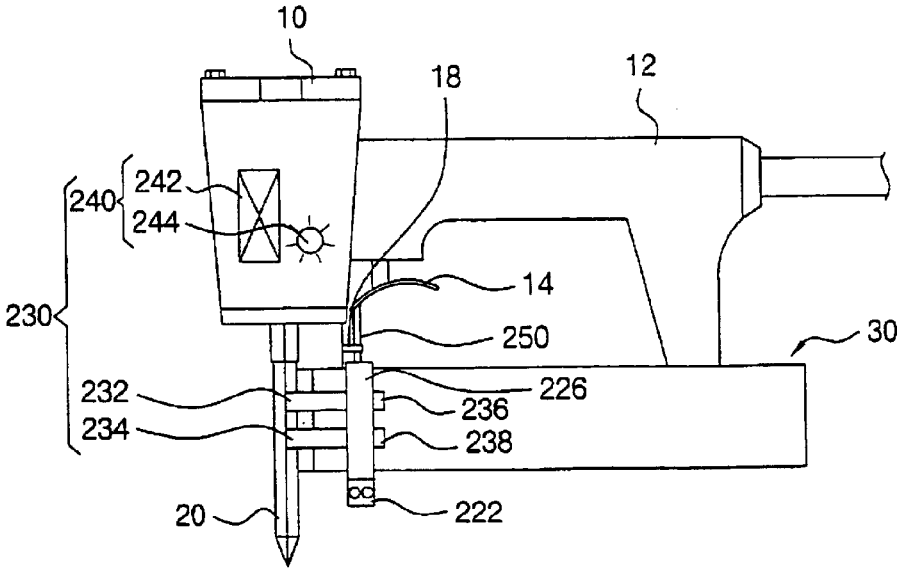

When the worker finishes the desired work, the pressing plate 34 pushes the nails 16 toward the nose portion 20 with the aid of the elastic force of the pressing spring 36 (referred to FIG. 6A). At this time, the worker can certify the remaining quantity of nails 16 in the cartridge 30 by seeing the display plate 212 which is exposed to the outside through the guide hole 38.

Meanwhile, if the nails 16 is exhausted without certifying the remaining quantity of nails 16 in the cartridge 30 during performing a work, the third stopping plate 226 is guided between the first ground plate 232 and the second ground plate 234. At this time, the third stopping plate 226 makes the recognition part 144 operate by closely contacting with the first ground protrusion 136 and the second ground protrusion 138 (referred to FIG. 6B). When the third stopping plate 226 is released from the first ground protrusion 136 and the second ground protrusion 138, the recognition part 244 stops operating.

As described above, the nailing machines 100, 200 according to the present invention comprise the display units 110, 210, which have the display plates 112, 212, and the trigger lever stoppers 120, 220, respectively. The display unit 110 has the connecting plate. The display plates 112, 212 are guided along the pressing plate 34 disposed in the cartridge 30. The nailing machines 100, 200 according to the present invention further comprise the alarming units 130, 230 having the first ground plates 132, 232, the second ground plates 134, 234 and the recognition parts 144, 244. The first ground plates 132, 232 are spaced apart from the second ground plates 134, 234 at a predetermined gap. The recognition part 144 may be operated by contact between the connecting plate 116 and the first and the second ground plates 132, 134. The recognition part 244 may be operated by contact between the stopping plate 220 and the first and the second ground plates 232, 234.

Due to this structure as described above, a worker easily perceives the existence and the residual quantity of the nail 16 contained in the cartridge 30. Furthermore, the apparatus is able to provide a worker with the fact that the nail is exhausted in the cartridge, as a sound and a light. As a result, the work efficiency may be enhanced through reduction in the number of processes. Consequently, the apparatus increases work efficiency and this make it possible to prevent unreliable execution of nailing works.

While the present invention has been particularly shown and described with reference to a particular embodiment thereof, it will be understood by those skilled in the art that various changes in form and details may be effected therein without departing from the spirit and scope of the invention as defined by the appended claims.

I claim:

1. A nailing machine having a main body for containing a driving cylinder and a driving piston, a nose portion for guiding nails being installed at a lower portion of the main body, and a cartridge, the main body including a grip portion for guiding a compressed air toward the driving cylinder and a trigger lever mounted to a lower portion of the grip portion, the cartridge having a pressing plate and a pressing spring, one side surface of the pressing plate being covered by a cover, the pressing plate having function to push the nails toward the nose portion, characterized by comprising:

a displaying unit having a display plate, a connecting plate and a trigger lever stopper, in which the display plate is formed in one body with the pressing plate and is perpendicular to the one side surface of the pressing plate, the displaying plate is projected toward the outside through a guiding hole formed through the cover in the longitudinal direction when the one side surface of the pressing plate being covered by the cover, the connecting plate is formed in one body with the display plate and extends toward the nose portion at a predetermined length along the one side surface of the pressing plate, the trigger lever stopper being mounted to an upper surface of the display plate, in which an insulating plate is attached to a distal end of the connecting plate, a conductive plate is attached to a part of an upper surface of the insulating plate; and an alarming unit including a first and a second ground plates formed at one side surface of the nose portion, a battery for supplying the first ground plate and the second ground plate with an electric source, and a recognition part, in which the first ground plate and the second ground pate are spaced apart from each other at a predetermined gap and they extend toward the connecting plate, a first ground protrusion and a second ground protrusion are respectively formed at the center portions of the first ground plate and the second ground plate, the conductive plate selectively contacting with the first ground plate and the second ground plate, the battery is disposed at the one side surface of the main body, the recognition part is disposed at a position adjacent to the battery and is electrically connected with the battery.

2. A nailing machine according to claim 1, characterized by the fact of the nailing machine further comprising a stopping bar mounted to a one side of the trigger lever and a position holding band being mounted to the lower portion of the main body at a position adjacent to the trigger lever, the stopping bar downwardly extending from the one side of the trigger lever to a position adjacent to an upper portion of the cartridge, the position holding band having function to smoothly guide the trigger lever downwards with enclosing a lower portion of the stopping bar.

3. A nailing machine according to claim 2, characterized by the fact of first through holes being formed through a middle portion of the display plate, the trigger lever stopper including a first stopping plate, a second stopping plate and a third stopping plate which are formed in one body together, in which second through holes corresponding to the first through holes are formed through a middle portion of the first stopping plate, the second stopping plate vertically extends between the first stopping plate and the third stopping plate, the first stopping plate horizontally extends from a lower end of the second stopping plate and the third stopping plate horizontally extends from an upper end of the second stopping plate in an opposite direction about the first stopping plate, the first stopping plate is engaged with the display plate by inserting bolts into the second through holes of the first stopping plate and the first through holes of the display plate, in which an operation of the trigger lever is controlled by selective contact between a distal end of the stopping bar and an upper surface of the third stopping plate.

4. A nailing machine according to claim 1, characterized by the fact of the insulating plate being made of an insulator, the conductive plate being made of an electric conductor, a part of the insulating plate being exposed to the outside at the distal end of the conductive plate so that it selectively closely contacts with the first ground protrusion and the second ground protrusion.

5. A nailing machine according to claim 1, characterized by the fact of the recognition part comprising a small electrical bulb for emitting a light.

6. A nailing machine according to claim 1, characterized by the fact of the recognition part comprising an alarm device for generating a sound.

7. A nailing machine having a main body for containing a driving cylinder and a driving piston, a nose portion for guiding nails being installed at a lower portion of the main body, and a cartridge, the main body including a grip portion for guiding a compressed air toward the driving cylinder and a trigger lever mounted to a lower portion of the grip portion, the cartridge having a pressing plate and a pressing spring, a lower surface of the pressing plate being covered by a cover, the pressing plate having function to push the nails toward the nose portion, characterized by comprising:

a displaying unit having a display plate and a trigger lever stopper, in which the display plate is formed in one body with the pressing plate and is projected toward the outside through a guiding hole formed through the cover in the longitudinal direction when the lower side surface of the pressing plate being covered by the cover, the trigger lever stopper being mounted to one side surface of the display plate; and an alarming unit including a first and a second ground plates formed at one side surface of the nose portion, a battery for supplying the first ground plate and the second ground plate with an electric source, and a recognition part, in which the first ground plate and the second ground pate are spaced apart from each other at a predetermined gap and they extend toward the trigger lever stopper, a first ground protrusion and a second ground protrusion are respectively formed at the center portions of the first ground plate and the second ground plate, the battery is disposed at the one side surface of the main body, the recognition part is disposed at a position adjacent to the battery and is electrically connected with the battery.

8. A nailing machine according to claim 7, characterized by the fact of the nailing machine further comprising a stopping bar mounted to a one side of the trigger lever and a position holding band being mounted to the lower portion of the main body at a position adjacent to the trigger lever, the stopping bar downwardly extending from the one side of the trigger lever to a position adjacent to an upper portion of the cartridge, the position holding band having function to smoothly guide the trigger lever downwards with enclosing a lower portion of the stopping bar.

9. A nailing machine according to claim 8, characterized by the fact of first through holes being formed through a lower portion of the display plate, the trigger lever stopper including a first stopping plate, a second-stopping plate, a third stopping plate and a fourth stopping plate which are formed in one body together, in which second through holes corresponding to the first through holes are formed through a middle portion of the first stopping plate, the second stopping plate horizontally extends between the first stopping plate and the third stopping plate, the first stopping plate vertically downwardly extends from one side end of the second stopping plate and the third stopping plate vertically upwardly extends from the other side end of the second stopping plate, the fourth stopping plate horizontally extends from an upper end of the third stopping plate, the first stopping plate is engaged with the display plate by inserting bolts into the second through holes of the first stopping plate and the first through holes of the display plate, in which an operation of the trigger lever is controlled by selective contact between a distal end of the stopping bar and an upper surface of the fourth stopping plate.

10. A nailing machine according to claim 7, characterized by the fact of the recognition part comprising a small electrical bulb for emitting a light.

11. A nailing machine according to claim 7, characterized by the fact of the recognition part comprising an alarm device for generating a sound.

* * * * *